US006561554B2

(12) United States Patent
Colbert et al.

(10) Patent No.: US 6,561,554 B2
(45) Date of Patent: May 13, 2003

(54) SIMPLIFIED LATCH AND ASSOCIATED ASSEMBLY METHOD

(75) Inventors: John Lee Colbert, Byron, MN (US); Steven Dale Greseth, Rochester, MN (US); William Michael Monson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/897,547

(22) Filed: Jul. 2, 2001

(65) Prior Publication Data

US 2003/0001394 A1 Jan. 2, 2003

(51) Int. Cl.[7] ..... E05C 19/10
(52) U.S. Cl. ..... 292/87; 292/128; 292/228
(58) Field of Search ..... 292/128, 87, 228, 292/126, 89, 85, 226, 113

(56) References Cited

U.S. PATENT DOCUMENTS 1,744,960 A * 1/1930 Garbell ..... 16/257
3,259,411 A * 7/1966 Griffiths ..... 292/113
3,797,870 A * 3/1974 Beckman ..... 292/108
4,632,348 A * 12/1986 Keesling et al. ..... 248/222.11
4,743,052 A * 5/1988 Stammreich et al. ..... 292/113
5,583,612 A * 12/1996 Schell et al. ..... 292/80
5,603,535 A * 2/1997 Antonucci et al. ..... 292/128
5,961,344 A * 10/1999 Rosales et al. ..... 439/495

* cited by examiner

*Primary Examiner*—Anthony Knight
*Assistant Examiner*—Mark Williams
(74) *Attorney, Agent, or Firm*—Wood, Herron & Evans, LLP

(57) ABSTRACT

A latch assembly for a computer or other electronic device includes a lever which is adapted to receive a spring arm integrally molded with a latch. The latch also includes integrally molded pivot pins which are guided by ramps into pivot holes in the lever to mate the latch and lever together. Once assembled, the latch is movable to and between engaged and disengaged positions for closure with a catch on the computer, electronic or other workpiece device. The latch assembly incorporates specific changes to existing parts while reducing the number of parts and the cost of and complexity for assembly. The design is much more easily accommodated in automated assembly equipment to further reduce assembly costs and increase productivity throughput.

25 Claims, 4 Drawing Sheets

SIMPLIFIED LATCH AND ASSOCIATED ASSEMBLY METHOD

FIELD OF THE INVENTION

The invention is generally related to a latch assembly for an electronic device. ore specifically, the invention is generally related to a specially designed latch assembly and the associated method for its assembly.

BACKGROUND OF THE INVENTION

Many computer related and other electronic devices generally include a chassis, cabinet or housing. During assembly and use, the chassis, cabinet or housing is selectively opened or closed. As such, one or more latches are typically provided. Because computer and other electronic devices are typically manufactured in enormous volumes, the cost of the components and the associated assembly time and complexity are important aspects of the design.

One prior art design for a latch assembly commonly utilized on a computer or other electronic device chassis, cabinet or housing (generally referred to as a "workpiece") is shown in FIG. 1. The prior art latch assembly includes a lever, a latch, two pivot pins and a compression spring. One of the pins is used to pivotally mount the latch assembly to the workpiece. The other pin and the compression spring are required to assemble the latch to the lever in an operative configuration.

Identified shortcomings of this and other similar prior art latch designs include the extra cost of both the compression spring and latch pin to hold the latch and lever together. Furthermore, during assembly and installation of the latch design shown in FIG. 1, great difficulty in aligning the latch with the spring and in aligning the latch, the lever and the latch pin for proper assembly resulted in a very complex and time consuming assembly and installation procedure. The latch design of FIG. 1 does not include appropriate features that allow for the registration and proper location of the latch relative to the lever during assembly. Therefore, great attention to the assembly procedure is required. Moreover, the spring and latch pin are both relatively tiny parts that are difficult to manipulate and hold in place during the assembly procedure of the latch assembly of FIG. 1.

The prior art latch design of FIG. 1 is also not conducive to automation during the assembly process. The prior art design takes too much time to assemble and the throughput of the end product in the manufacturing process is relatively low.

Therefore, in view of these and other problems associated with known types of latch assemblies, there is a need for an improved latch assembly design that can be efficiently and economically assembled, and that is easy to operate and provides an effective and secure closure.

Further, an improved latch design must satisfy both aesthetic and ergonomic requirements. Specifically, since the latch design is typically used on a consumer item, such a component must have a pleasing and appealing shape or appearance. From an ergonomic perspective, since prior art latch assemblies are in use in a large number of existing computer and electronic devices, the overall operation of an improved latch assembly must not be significantly altered. Otherwise, a user having both the improved and prior art latch designs could be confused.

SUMMARY OF THE INVENTION

The invention meets and exceeds the above-described and other needs by providing an improved latch assembly design for use on computer-related and other electronic devices, generally referred to as workpieces. In a present embodiment of this invention, a latch assembly is adapted to be pivotally coupled to a workpiece such as a computer or other electronic device chassis, cabinet or housing. The latch assembly includes a latch that has a grip for actuation of the latch by a user to and between an engaged position and a disengaged position. A hook is also provided on the latch to engage a catch on the workpiece when the latch is in the engaged position.

The latch includes an elongate spring arm that is integrally formed with the latch to bias the hook into engagement with the catch. The latch also includes a pair of pivot pins that are integrally formed with the latch and define a pivot access about which the latch pivots to and between the engaged and disengaged positions.

Advantageously, the latch with the integrally formed spring arm and pivot pins is manually snap-fit into a lever to complete the latch assembly. The lever includes a pair of pivot holes into which the pivot pins on the latch are snap-fit to pivotally couple the latch and the lever together. A lead-in ramp is configured in the lever proximate each of the pivot holes to guide the pivot pins into the holes during the assembly process. In one embodiment of this invention, the lever includes a pair of pockets, each of which are adapted to receive therein one of the spring fingers projecting from a terminal end of the spring arm on the latch. As a result, the lever has a pocket design that allows the lever to accept the spring arm of the latch and thereby minimize the need for extra parts and a separate compression spring. The pocket in the lever captures the spring arm and induces a preload in the latch assembly to ensure that the latch simply stays in the engaged position until actuated by a user. The lever includes a stop to contact the spring arm and limit the movement of the spring arm between the engaged and disengaged positions.

As a result, an improved latch design according to this invention uses a snap-in feature that eliminates the need for a separate pivot pin coupling the latch and lever together. Additionally, the integrally formed spring arm on the latch eliminates the need for a compression spring. The improved latch design has the pin and spring arm molded integrally with the latch. As such, the extra cost of the pin and the spring used in the prior art designs is eliminated. Assembly of the latch and the lever together is simply accomplished by snapping the spring arm into the pocket in the lever without the need for special tooling or complex procedures.

The lever itself is modified only slightly to incorporate the pocket. Changes to the latch and lever appliance and the operation of the latch assembly are minimal to accomplish both the aesthetic and ergonomic objectives of an improved design. As such, the improved latch assembly incorporates specific changes to existing parts while still providing for the reduction of costs, parts and assembly procedures. The improved design much more easily accommodates automatic assembly equipment to further reduce assembly costs and increase productivity rates. Moreover, the improved design provides the same feel and function as existing designs thereby satisfying ergonomic requirements.

These and other advantages and features which characterize the invention, are set forth in the claims annexed hereto and in forming a further part hereof. However, for a better understanding of the invention, and of the advantages and objectives attained through its use, reference should be made to the drawings, and to the accompanying descriptive matter, in which exemplary embodiments of the invention are described.

BRIEF DESCRIPTION OF THE DRAWINGS

The objectives and features of the invention will become more readily apparent from the following detailed description taken in conjunction with the accompanying drawings in which.

DETAILED DESCRIPTION

Figure 1:
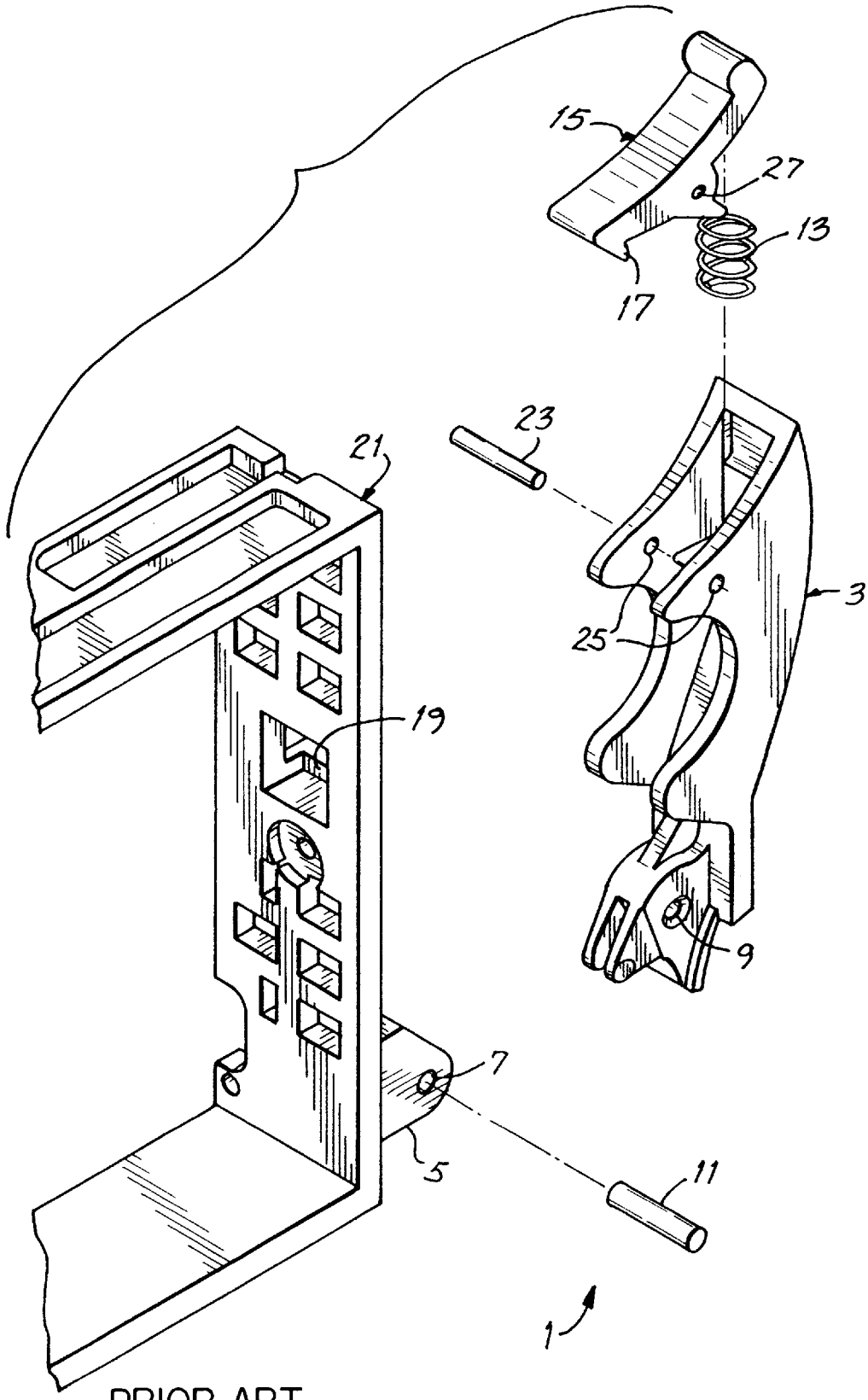
PRIOR ART FIG. 1
FIG. 1 is a perspective exploded view of a prior art latch assembly design.

Turning to the Drawings, wherein like numbers denote like parts throughout the several views, FIG. 1 shows a prior art latch assembly 1 as previously described herein. Briefly, the prior art latch assembly 1 includes a lever 3 which is pivotally coupled to a mounting block 5 having a pivot pin aperture 7 there through. The lever 3 likewise includes a pivot pin aperture 9 through which a lever pin 11 is inserted. Furthermore, the prior art latch assembly 1 includes a compression spring 13 to bias a latch 15 into an engaged position so that a hook 17 on the latch 15 may engage a catch 19 on the workpiece 21 for closure of the latch assembly 1. The latch 15 is pivotally coupled to the lever 3 by a latch pin 23 inserted through aligned pivot holes 25 in the lever 3 and a throughhole 27 in the latch 15. As a result, the number of components of the prior art latch assembly 1 and the size of the components and precision and complexity required during the assembly of those components into the operational latch assembly 1 provides significant problems during a mass production assembly and manufacturing process.

Figure 2:
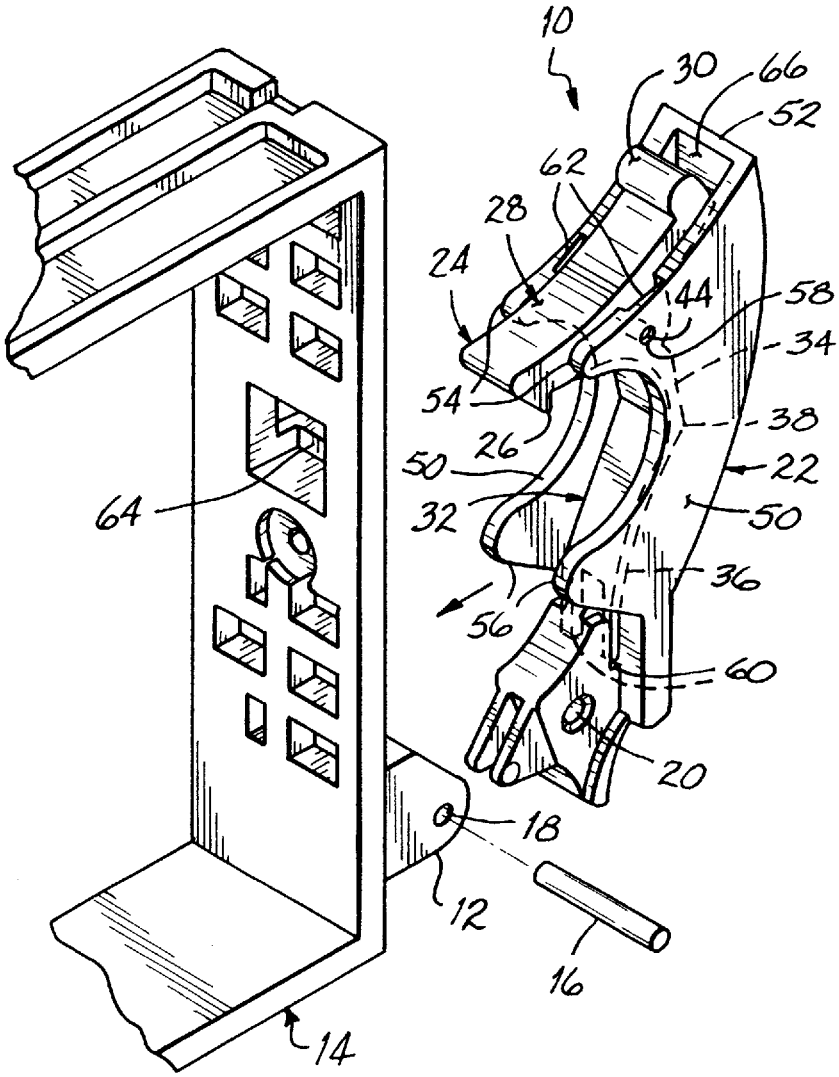
FIG. 2 is a perspective view of a latch assembly according to one embodiment of this invention being pivotally coupled by a pivot pin to a workpiece.
Figure 3:
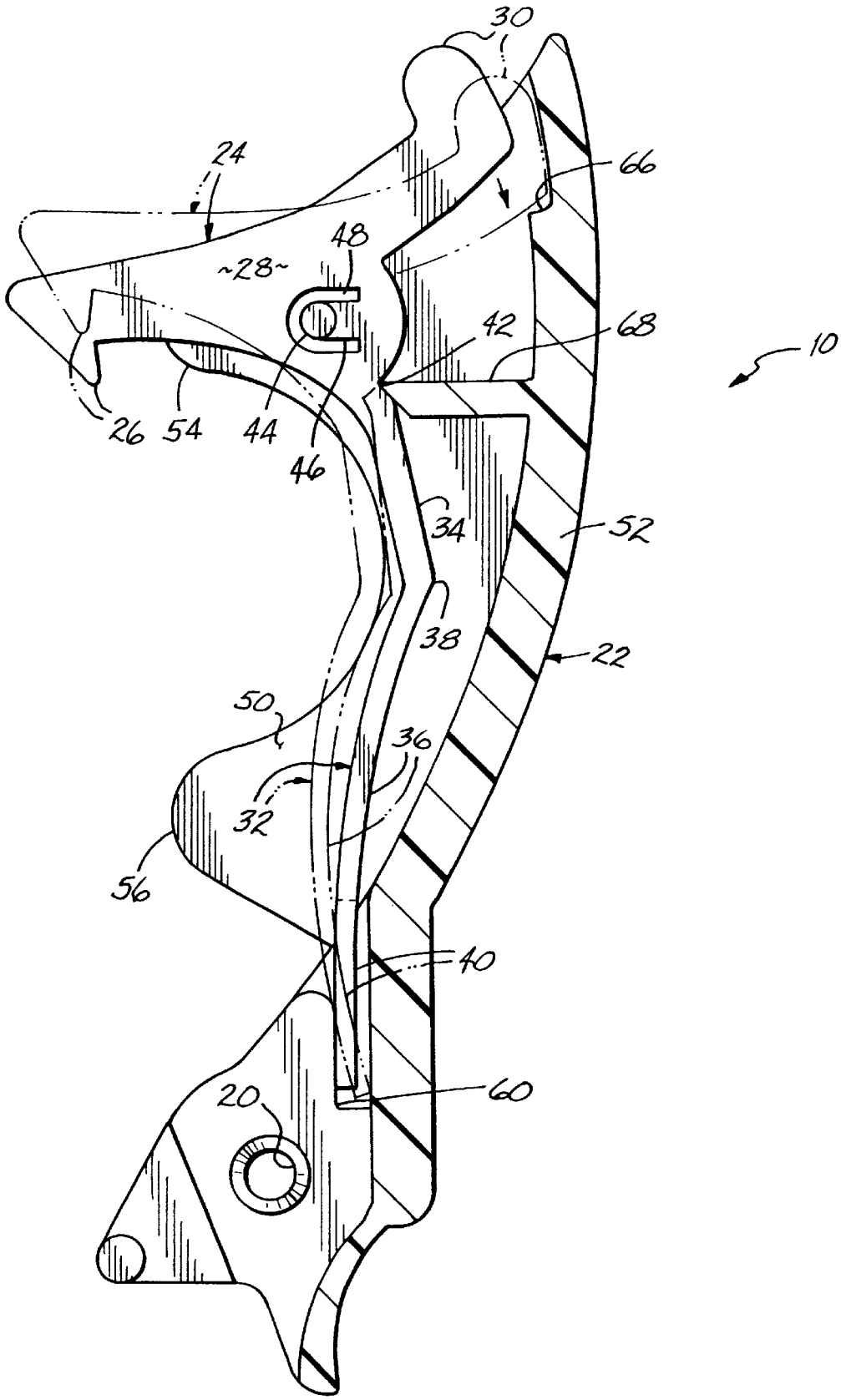
FIG. 3 is a cross-sectional side elevational view of the latch assembly according to one embodiment of this invention.
Figure 4:
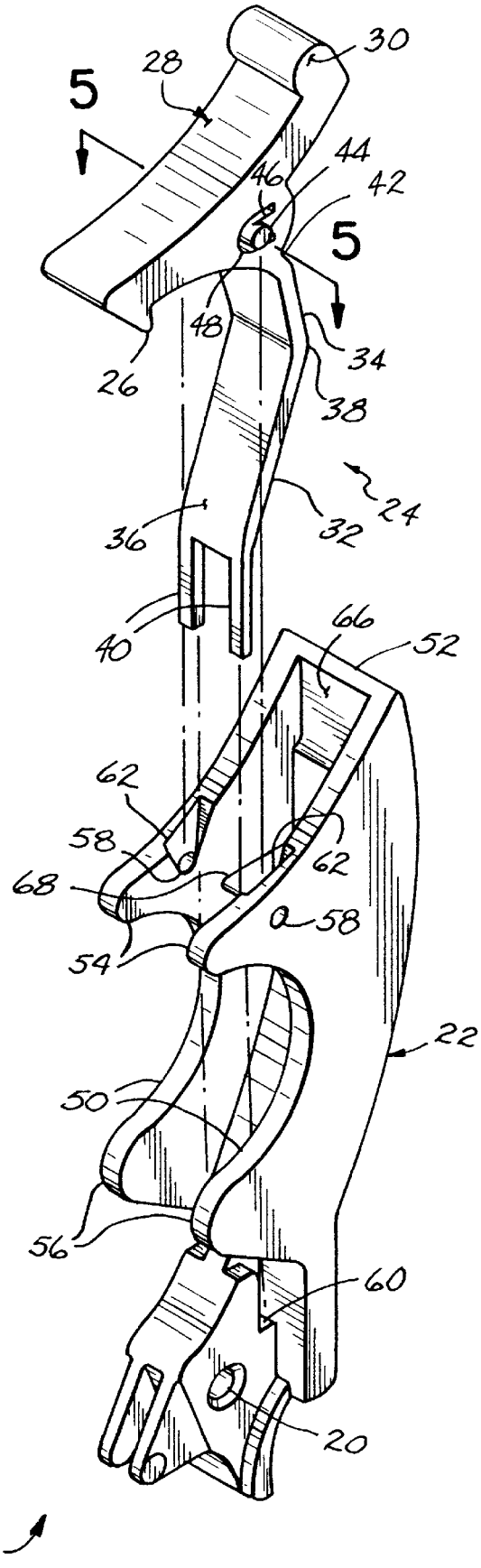
FIG. 4 is an exploded perspective view of the latch and lever components of this invention.

Referring to FIGS. 2–4, an improved latch assembly 10 according to one embodiment of this invention is shown. The latch assembly 10 is likewise pivotally coupled to a mounting block 12 of a workpiece 14 by a lever pin 16 inserted through a pivot hole 18 in the mounting block 12 and a hole 20 in the base of a lever 22 adapted to be aligned with the pivot hole 18 in the block 12. As such, the latch assembly 10 of this invention is pivotally coupled to the workpiece 14.

The latch assembly 10 according to one embodiment of this invention includes an integrally molded unitary latch 24. The latch 24 has a generally T-shaped configuration with a hook 26 formed on one end of a latch body 28. A grip 30 is formed on the opposite end of the latch body 28 from the hook 26. The latch 24 includes an elongate spring arm 32 which projects downwardly from the latch body 28. The spring arm 32 includes an upper spring arm 34 and a lower spring arm 36 joined together by an elbow 38. A terminal end of the spring arm is bifurcated to include a pair of spaced spring fingers 40, 40 as shown particularly in FIG. 4. A saddle notch 42 is provided in the latch 24 at the juncture between the latch body 28 and the spring arm 32.

Figure 5:
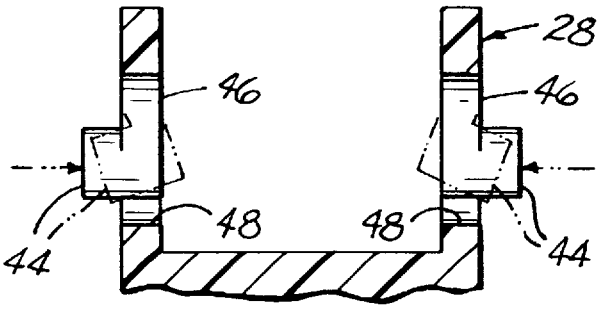
FIG. 5 is a cross-sectional view taken along line 5—5 of FIG. 4 showing the pivot pins integrally formed with the latch according to this invention.

A pair of pivot pins 44, 44 are integrally formed on the latch body 28, as shown particularly in FIGS. 3–5. One pivot pin 44 is formed on each side of the latch body 28, has a generally cylindrical shape and is located at the terminal end of a flap 46 that is cantilevered to the latch body 28. A U-shaped opening 48 surrounds the flaps 46 on all but one side of the flaps 46. The flap 46 is flexible relative to the latch body 28 so that the pivot pins 44, 44 can be temporarily deflected inwardly during assembly of the latch assembly 10. Nevertheless, the pivot pins 44, 44 are biased outwardly, as shown in FIG. 5. Advantageously, the spring arm 32, latch body 28, hook 26, grip 30 and pivot pins 44, 44 are integrally formed together for ease of assembly 10 of the latch assembly and an overall reduction in the number of component parts required for assembly.

The latch assembly 10 includes the lever 22 which has a generally U-shaped cross-sectional configuration with a pair of flanges 50, 50 which are mirror images of one another projecting from a spine 52 of the lever 22. Each flange includes an upper lobe 54 and a lower lobe 56 similar in this regard to the aesthetic and ergonomic aspects of the prior art latch assembly 1 of FIG. 1. Each flange 50 of the lever 22 includes a pivot hole 58 in the upper lobe 54 to receive one of the pivot pins 44 on the latch 24. Additionally, the lever 22 includes a pair of spaced pockets 60, 60 at the lower end thereof, each of which is designed to receive therein one of the spring fingers 40 of the spring arm 32 on the latch 24. Assembly of the latch 24 to the lever 22 simply entails insertion of the terminal end of the spring arm 32 longitudinally into the lever 22 as shown in FIG. 4 until each of the spring fingers 40 is inserted into one of the pockets 60 in the lever 22. As the spring fingers 40 become seated in the pockets 60, the pivot pins 44, 44 on the latch body 28 temporarily deflect inwardly (FIG. 5) and are guided into the respective pivot holes 58, 58 by a lead-in ramp 62 formed in the lever 22 proximate each of the pivot holes 58. The simplified assembly procedure for the latch 10 design according to this invention results in increased productivity and throughput during the manufacturing process due in large part to the reduced number of components and the ease with which those components are assembled.

Once the latch 24 is assembled with the lever 22, the latch 24 is biased toward the engaged position so that the hook 26 engages a catch 64 on the workpiece 14. Nevertheless, a user may disengage the latch 24 from the catch 64 and pivot the latch 24 to the disengaged position by depressing the grip 30 until it contacts a socket 66 formed in the spine at the upper end of the lever 22. The pivotal movement of the latch 24 to and between the engaged and disengaged positions is limited during flexing of the spring arm 32 by a stop 68 projecting from the spine 52 of the lever 22 to contact the saddle notch 42 at the juncture between the latch body 28 and the spring arm 32, as shown in FIG. 3. Therefore, as a result of the spring arm 32 and interaction between the latch 24 and the lever 22, the latch 24 is biased into the engaged position as shown in FIG. 3. Nevertheless, the latch 24 may be pivoted about the pivot pins 44, 44 to flex the spring arm 32 into the disengaged position of the latch 24 as shown in dashed lines in FIG. 3. Once the grip 30 is released by the user, the latch 24 will return to the engaged position as a result of the bias of the spring arm 32 and the interaction with the lever 22.

It should be readily appreciated that although the pivot pins 44, 44 are shown as being integrally molded on the latch 24 for receipt into pivot holes 58, 58 in the lever 22, the pivot pins may alternatively be integrally molded with the lever 22 for receipt into pivot holes in the latch 24 to pivotally couple the latch 24 and lever 22 together. Additionally, alternative designs for the spring arm 32 integrally molded with the latch 24 can readily be envisioned within the scope of this invention.

Nevertheless, the present invention does provide a simplified assembly procedure in an improved latch assembly 10 to thereby increase output and reduce the number of associated component parts and assembly procedures. Moreover, the aesthetics and ergonomics of the improved latch assembly 10 complement those features of prior art latch designs.

From the above disclosure of the general principals of the present invention and the preceding detailed description of at least one preferred embodiment, those skilled in the art will readily comprehend the various modifications to which this invention is susceptible. Therefore, we desire to be limited only by the scope of the following claims and equivalents thereof.

What is claimed is:

1. A latch assembly adapted to be pivotally coupled to a workpiece comprising:

a latch having a grip for actuation of the latch by a user to and between an engaged position and a disengaged position;

a hook on the latch adapted to be engaged with the workpiece with the latch in the engaged position;

a biasing member integrally formed with the latch to bias the hook into the engaged position;

a lever selectively mated with the latch, the lever adapted to be pivotally coupled to the workpiece;

a pivot pin integrally formed with one of the latch and the lever;

a pivot axis defined by the pivot pin about which the latch pivots to and between the engaged and disengaged positions;

a pivot hole in the other one of the latch and the lever adapted to receive therein the pivot pin when the lever and latch are mated together; and a pocket in the lever adapted to receive therein a terminal end of the biasing member when the lever and latch are mated together.

2. The latch assembly of claim 1 wherein the biasing member further comprises an elongate spring arm and the terminal end of the spring arm is adapted to be received into the pocket of the lever.

3. The latch assembly of claim 2 wherein the elongate spring arm further comprises an upper spring arm and a lower spring arm joined to each other at an elbow.

4. The latch assembly of claim 2 further comprising:

a pair of the pockets in the lever; and a pair of spaced spring fingers at the terminal end of the elongate spring arm, wherein each of the spring fingers is adapted to be received into one of the pockets of the lever.

5. The latch assembly of claim 1 further comprising:

a stop on the lever adapted to engage and limit movement of the biasing member.

6. The latch assembly of claim 1 further comprising:

a pair of the pivot pins each being integrally formed with the latch and aligned on the pivot axis; and a pair of the pivot holes in the lever, wherein each of the pivot pins is adapted to be received into one of the pivot holes for pivotal movement of the latch relative to the lever to and between the engaged and disengaged positions.

7. The latch assembly of claim 6 further comprising:

a pair of flaps each of which is cantilevered to the latch and has one of the pivot pins at a terminal end thereof, each of the flaps biasing the respective pivot pin outwardly to be seated into the respective pivot hole when the latch and lever are mated together, each of the pivot pins being adapted to be temporarily deflected inwardly while the latch and the lever are being mated together.

8. The latch assembly of claim 1 further comprising:

a ramp proximate the pivot hole, the ramp being adapted to guide the pivot pin into the pivot hole when the latch and lever are being mated together.

9. The latch assembly of claim 1, wherein said biasing member extends generally perpendicularly from said latch.

10. A latch assembly adapted to be pivotally coupled to a workpiece comprising:

a latch having a grip for actuation of the latch by a user to and between an engaged position and a disengaged position;

a hook on the latch adapted to be engaged with the workpiece when the latch is in the engaged position;

an elongate spring arm integrally formed with the latch to bias the hook into the engaged position;

a pair of spaced spring fingers at the terminal end of the elongate spring arm;

a pair of pivot pins each being integrally formed with the latch;

a pivot axis defined by the pivot pins about which the latch pivots to and between the engaged and disengaged positions;

a lever selectively mated with the latch, the lever adapted to be pivotally coupled to the workpiece;

a pair of pivot holes in the lever, each pivot hole being adapted to receive therein one of the pivot pins of the latch when the lever and latch are mated together;

a pair of ramps on the lever, each ramp being proximate one of the pivot holes, the ramps being adapted to guide the respective pivot pin into the respective pivot hole when the latch and lever are being mated together;

a pair of flaps each of which is integrally formed with and cantilevered to the latch and has one of the pivot pins at a terminal end thereof, each of the flaps biasing the respective pivot pin outwardly to be seated into the respective pivot hole when the latch and lever are mated together, each of the pivot pins being adapted to be temporarily deflected inwardly while the latch and the lever are being mated together;

a pair of pockets in the lever each being adapted to receive therein one of the spring fingers at the terminal end of the elongate spring arm when the lever and latch are mated together; and a stop on the lever adapted to engage and limit movement of the elongate spring arm.

11. The latch assembly of clain 10, wherein said biasing member extends generally perpendicularly from said latch.

12. A latch assembly adapted to be pivotally coupled to a workpiece comprising:

a latch having a grip for actuation of the latch by a user to and between an engaged position and a disengaged position;

a hook on the latch adapted to be engaged with the workpiece with the latch in the engaged position;

an elongate spring arm integrally formed with the latch to bias the hook into the engaged position, the elongate spring arm having a terminal end;

a lever selectively mated with the latch, the lever adapted to be pivotally coupled to the workpiece;

a pivot pin pivotally coupling the latch and the lever;

a pivot axis defined by the pivot pin about which the latch pivots to and between the engaged and disengaged positions; and a pocket in the lever adapted to receive therein the terminal end of the spring arm when the lever and latch are mated together.

13. The latch assembly of claim 9 wherein the elongate spring arm further comprises an upper spring arm and a lower spring arm joined to each other at an elbow.

14. The latch assembly of claim 9 further comprising:

a pair of the pockets in the lever; and a pair of spaced spring fingers at the terminal end of the elongate spring arm, wherein each of the spring fingers is adapted to be received into one of the pockets of the lever.

15. The latch assembly of claim 9 further comprising:

a stop on the lever adapted to engage and limit movement of the elongate spring arm.

16. The latch assembly of claim 9, wherein said biasing member extends generally perpendicularly from said latch.

17. A latch assembly adapted to be pivotally coupled to a workpiece comprising:

a latch having a grip for actuation of the latch by a user to and between an engaged position and a disengaged position;

a hook on the latch adapted to be engaged with the workpiece with the latch in the engaged position;

an elongate spring arm integrally formed with the latch to bias the hook into the engaged position;

wherein the elongate spring arm further comprises an upper spring arm and a lower spring arm joined to each other at an elbow;

a pair of spaced spring fingers at a terminal end of the elongate spring arm;

a lever selectively mated with the latch, the lever adapted to be pivotally coupled to the workpiece;

a pivot pin pivotally coupling the latch and the lever;

a pivot axis defined by the pivot pin about which the latch pivots to and between the engaged and disengaged positions;

a pair of pockets in the lever each adapted to receive therein one of the spring fingers at the terminal end of the spring arm when the lever and latch are mated together; and a stop on the lever adapted to engage and limit movement of the elongate spring arm.

18. The latch assembly of claim 17, wherein said biasing member extends generally perpendicularly from said latch.

19. A method of assembling a latch assembly adapted to be coupled to a workpiece, the method comprising the steps of:

inserting a terminal end of a biasing member projecting from a latch into a pocket in a lever;

wherein the latch has a grip for actuation by a user to and between an engaged position and a disengaged position, the latch further comprising a hook adapted to engage the workpiece when in the engaged position and when the latch assembly is coupled to the workpiece, the hook being adapted to be disengaged from the workpiece when in the disengaged position;

wherein the biasing member biases the latch into the engaged position;

wherein the biasing member is integrally formed with the latch; and pivotally coupling the latch and the lever together for pivotal movement of the latch relative to the lever about a pivot pin to and between the engaged and disengaged positions;

wherein the pivot pin is integrally formed with one of the latch and the lever.

20. The method of claim 19 wherein the terminal end of the biasing member further comprises a pair of spaced spring fingers and the lever further comprises a pair of the pockets, the inserting further comprising inserting each of the spring fingers into one of the pockets.

21. The method of claim 19 wherein the biasing member further comprises an elongate spring arm integrally formed with the latch, the inserting further comprising:

positioning a stop on the lever at a juncture between the elongate spring arm and the latch to limit movement of the elongate spring arm.

22. The method of claim 19 wherein the pivotally coupling of the latch and the lever further comprises:

seating the pivot pin into a pivot hole in the other of the latch and the lever.

23. The method of claim 22 further comprising:

guiding the pivot pin into the pivot hole with a ramp proximate the pivot hole.

24. The method of claim 22 wherein the pivotally coupling further comprises:

temporarily deflecting a flap integrally formed with and cantilevered from the one of the latch and the lever until the pivot pin is seated in the pivot hole.

25. A method of assembling a latch assembly adapted to be coupled to a workpiece, the method comprising the steps of:

inserting each of a pair of spaced spring fingers at a terminal end of an elongate spring arm projecting from a latch into one of a pair of pockets in a lever;

wherein the latch has a grip for actuation by a user to and between an engaged position and a disengaged position, the latch further comprising a hook adapted to engage the workpiece when in the engaged position and when the latch assembly is coupled to the workpiece, the hook being adapted to be disengaged from the workpiece when in the disengaged position;

wherein the elongate spring arm biases the latch into the engaged position;

wherein the elongate spring arm is integrally formed with the latch;

seating a pivot pin on the latch into a pivot hole in the lever to thereby pivotally couple the latch and the lever together for pivotal movement of the latch relative to the lever to and between the engaged and disengaged positions;

wherein the pivot pin is integrally formed with the latch;

guiding the pivot pin into the pivot hole with a ramp proximate the pivot hole;

temporarily deflecting a flap integrally formed with and cantilevered from the latch until the pivot pin is seated in the pivot hole; and positioning a stop on the lever at a juncture between the elongate spring arm and the latch to limit movement of the elongate spring arm.

* * * * *